US009233462B2

(12) United States Patent
LaPorte

(10) Patent No.: US 9,233,462 B2
(45) Date of Patent: Jan. 12, 2016

(54) HAMMER

(71) Applicant: Milwaukee Electric Tool Corporation, Brookfield, WI (US)

(72) Inventor: Zachary LaPorte, Franklin, WI (US)

(73) Assignee: Milwaukee Electric Tool Corporation, Brookfield, WI (US)

( * ) Notice: Subject to any disclaimer, the term of this patent is extended or adjusted under 35 U.S.C. 154(b) by 249 days.

(21) Appl. No.: 14/059,158

(22) Filed: Oct. 21, 2013

(65) Prior Publication Data

US 2015/0107417 A1 Apr. 23, 2015

(51) Int. Cl.

| | |
|---|---|
| ***B25G 3/14*** | (2006.01) |
| ***B25D 1/00*** | (2006.01) |
| ***B25D 1/06*** | (2006.01) |

(52) U.S. Cl.
CPC ... *B25G 3/14* (2013.01); *B25D 1/06* (2013.01)

(58) Field of Classification Search
CPC ..... B25D 1/00; B25D 1/04; B25D 1/06; B25D 1/12; B25G 3/14
USPC ..... 81/20, 22, 24
See application file for complete search history.

(56) References Cited

U.S. PATENT DOCUMENTS

| | | | | |
|---|---|---|---|---|
| 3,355,226 | A | 11/1967 | Portz | |
| 3,613,753 | A | 10/1971 | Wolf | |
| 3,753,602 | A | 8/1973 | Carmien | |
| 3,874,433 | A | 4/1975 | Shepherd, Jr. et al. | |
| 3,877,826 | A | 4/1975 | Shepherd, Jr. et al. | |
| 3,879,145 | A * | 4/1975 | Carmien et al. | 81/20 |
| 4,030,847 | A | 6/1977 | Carmien | |
| 4,085,784 | A | 4/1978 | Fish | |
| 4,089,356 | A | 5/1978 | O'Connor | |
| 4,165,771 | A | 8/1979 | Curati, Jr. | |
| 4,188,703 | A | 2/1980 | Fish | |
| 4,291,998 | A | 9/1981 | Santos | |
| 4,352,381 | A | 10/1982 | Provi | |
| 4,367,969 | A | 1/1983 | Carmien | |
| 4,516,615 | A | 5/1985 | Finn | |
| 5,056,381 | A | 10/1991 | Carmein | |
| 5,259,274 | A | 11/1993 | Hreha | |
| 5,320,001 | A | 6/1994 | Floyd | |
| 5,490,437 | A | 2/1996 | Hebert et al. | |
| 5,588,343 | A | 12/1996 | Rust et al. | |
| 5,896,788 | A | 4/1999 | Hreha et al. | |
| 6,158,307 | A * | 12/2000 | Lamond et al. | 81/22 |
| 6,477,922 | B1 | 11/2002 | Burnett | |
| 7,096,761 | B2 | 8/2006 | Schoor | |
| 7,181,994 | B2 | 2/2007 | Norton | |
| 2014/0165787 | A1 * | 6/2014 | Lombardi | 81/22 |

* cited by examiner

*Primary Examiner* — Hadi Shakeri
(74) *Attorney, Agent, or Firm* — Michael Best & Friedrich LLP

(57) ABSTRACT

A striking tool includes a striking head, a passage extending through the striking head, and an elongated handle defining a longitudinal axis. The elongated handle has a mounting portion disposed in the passage, and the mounting portion includes a finger and a plurality of ribs extending outwardly from the finger to define a gap between the ribs and an internal wall of the passage. The striking tool further includes a resin filling a volume between the mounting portion and the passage to provide an adhesive bond between the striking head and the handle. The resin interlocks with the ribs to provide a mechanical bond between the striking head and the handle.

17 Claims, 4 Drawing Sheets

HAMMER

FIELD OF THE INVENTION

The present invention relates to a hand tools, and more particularly to hand-held striking tools.

BACKGROUND

Hand-held striking tools, such as hammers, typically include a metal head for striking a workpiece and a handle coupled to the head.

SUMMARY

The invention provides, in one aspect, a striking tool including a striking head, a passage extending through the striking head, and an elongated handle defining a longitudinal axis. The elongated handle has a mounting portion disposed in the passage, and the mounting portion includes a finger and a plurality of ribs extending outwardly from the finger to define a gap between the ribs and an internal wall of the passage. The striking tool further includes a resin filling a volume between the mounting portion and the passage to provide an adhesive bond between the striking head and the handle. The resin interlocks with the ribs to provide a mechanical bond between the striking head and the handle.

The invention provides, in another aspect, a method of attaching a striking head to a handle of a striking tool, the handle including a generally rigid core and a sleeve surrounding the core. The method includes inserting a mounting portion of the handle into a passage extending through the head. The method further includes filling a volume between the mounting portion and the passage with a resin, and interlocking the resin with a plurality of ribs extending outwardly from a finger on the sleeve of the handle to provide a mechanical bond between the striking head and the handle.

Other features and aspects of the invention will become apparent by consideration of the following detailed description and accompanying drawings.

Before any embodiments of the invention are explained in detail, it is to be understood that the invention is not limited in its application to the details of construction and the arrangement of components set forth in the following description or illustrated in the following drawings. The invention is capable of other embodiments and of being practiced or of being carried out in various ways. Also, it is to be understood that the phraseology and terminology used herein is for the purpose of description and should not be regarded as limiting.

DETAILED DESCRIPTION

FIGS. 1-5 illustrate a hand-held striking tool 10 embodying aspects of the invention. Although the hand-held striking tool

10 is illustrated in FIGS. 1-5 as a claw-type hammer, the embodiments of the invention described herein are equally applicable to a wide variety of hand-held striking tools, including for example ball-peen hammers, mallets, axes, hatchets, picks, etc.

Figure 1:
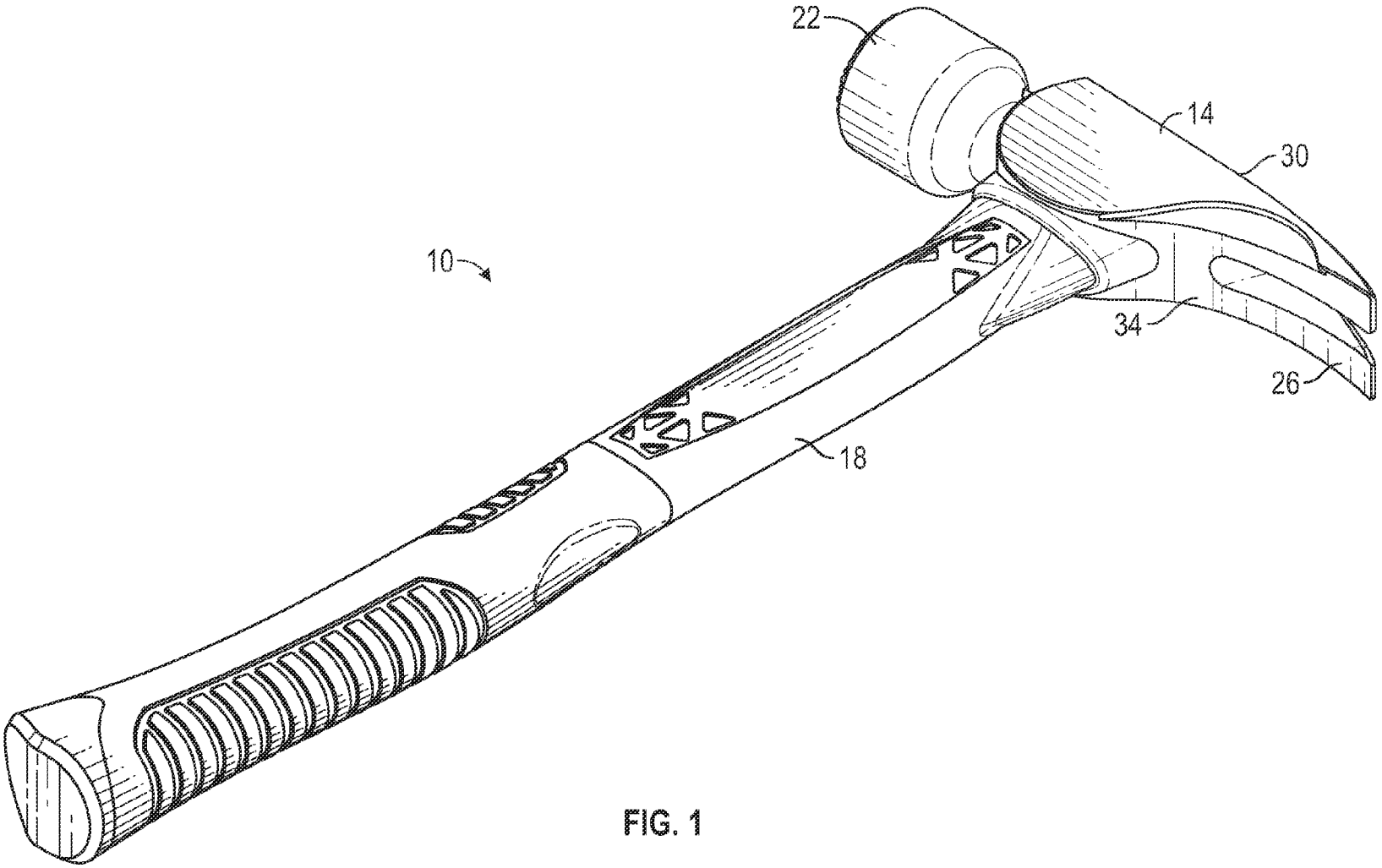
FIG. 1 is a perspective view of a hammer according to an embodiment of the invention.

With reference to FIG. 1, the striking tool 10 includes a striking head 14 and a handle 18. The striking head 14 has an impact end 22, a claw end 26, and top and bottom sides 30, 34 extending between the impact end 22 and the claw end 26. The striking head 14 is made of titanium alloyed with approximately 6% aluminum and 4% vanadium, also known as Grade 5 titanium alloy. Alternatively, the striking head 14 can be made of any other sufficiently strong, impact-resistant material. In some embodiments, the head 14 weighs about 14 ounces. In other embodiments, the head 14 weighs about 12 ounces. In yet other embodiments, the head 14 weighs about 10 ounces.

Figure 4:
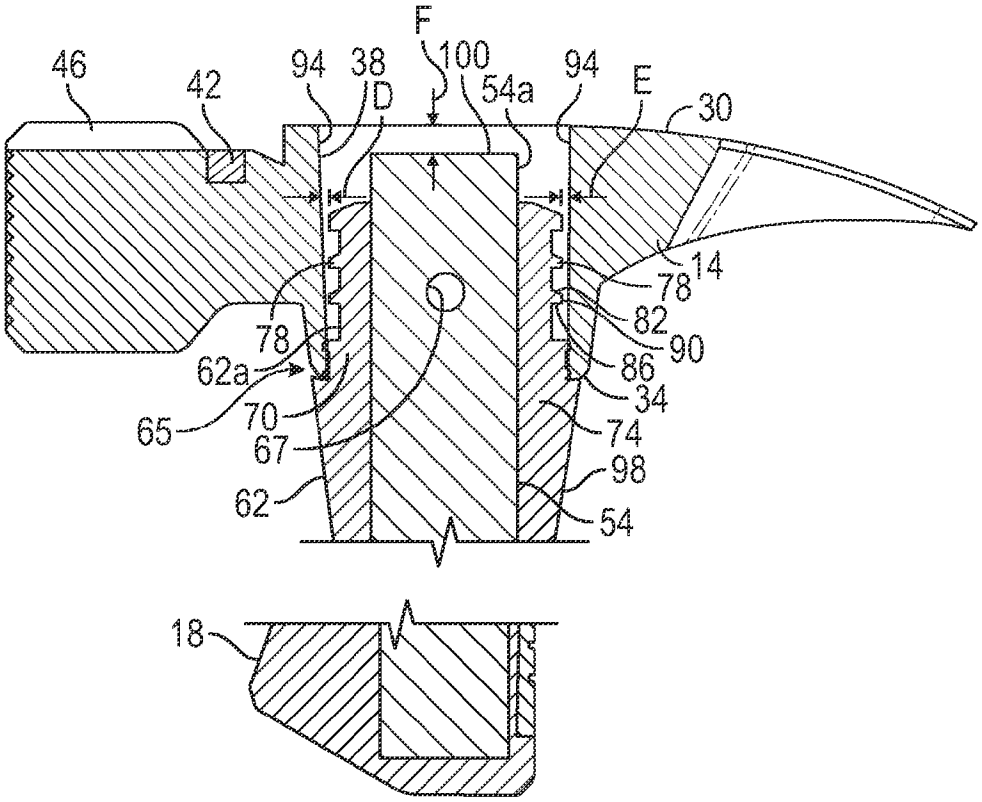
FIG. 4 is a cross-sectional view of the hammer, taken along line 4-4 in FIG. 3.
Figure 3:
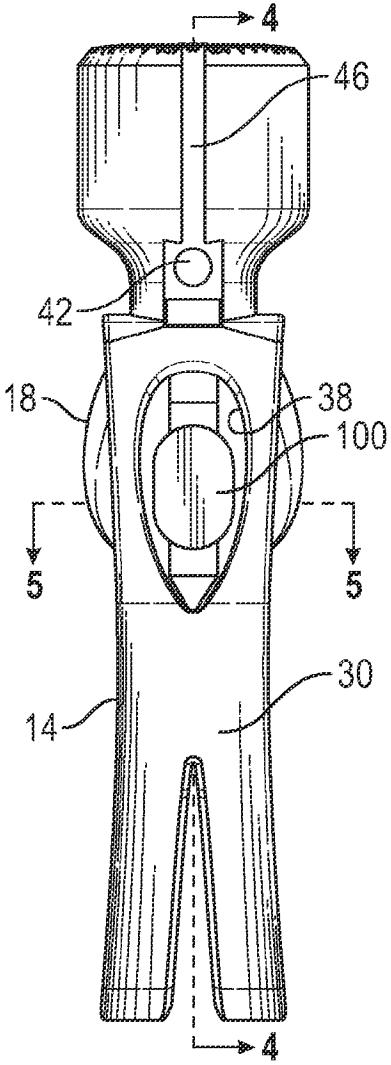
FIG. 3 is a top view of the hammer of FIG. 1.

Best illustrated in FIGS. 3 and 4, an eye passage 38, having a generally teardrop-shaped cross-section, extends vertically through the striking head 14 from the top side 30 to bottom side 34. In other embodiments, the eye passage 38 may have a differently-shaped cross-section, such as a circular or rectangular cross-section. The illustrated striking tool 10 further includes a magnet 42 located on the top side 30 of the striking head 14. The magnet 42 may be secured to the striking head 14 by a press-fit, adhesive, or other suitable arrangement. A groove 46 extends from the magnet 42 to the impact end 22. A nail (not shown) can be positioned in the groove 46 and held in place by the magnet 42. This arrangement allows a user to initiate a nail-driving operation without holding on to the nail.

Figure 2:
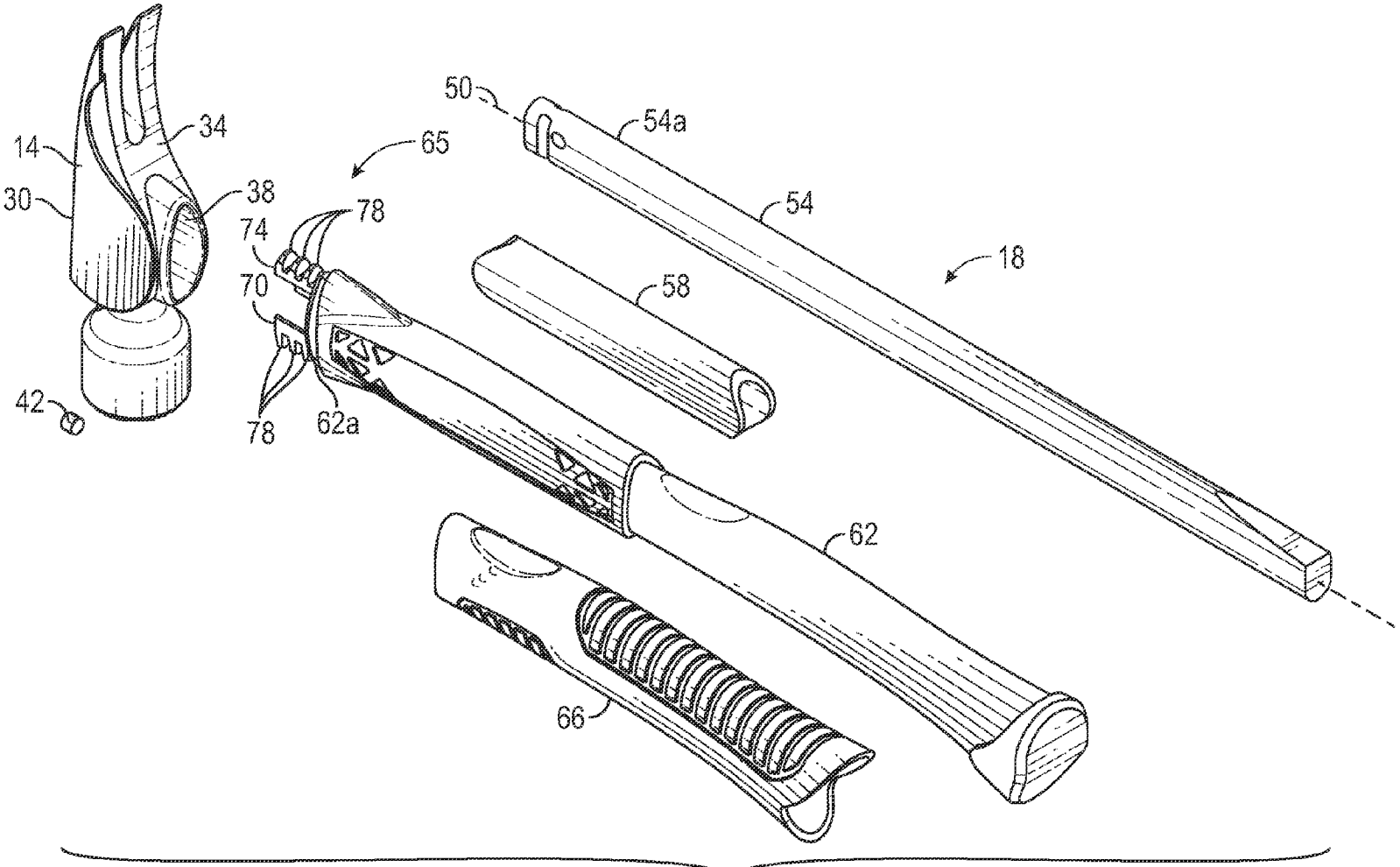
FIG. 2 is an exploded view of the hammer of FIG. 1.

Referring to FIG. 2, the handle 18 defines a longitudinal axis 50 and includes a central core 54 made of fiberglass or another suitable high-strength material. A portion of the core 54 is surrounded by a first sleeve 58 molded thereon (e.g., using an insert molding process). The first sleeve 58 is made of polypropylene or another suitable rigid or semi-rigid polymer and may include a logo or other indicia (not shown). A second sleeve 62 is subsequently molded over the core 54 and the first sleeve 58 (e.g., using another insert molding process). Like the first sleeve 58, the second sleeve 62 is made of polypropylene or another suitable polymer. The second sleeve 62 can include a logo or other indicia (not shown) complementing the first logo to create a multi-color and/or three-dimensional logo. The handle 18 further includes an elastomeric grip portion 66 overmolded on the second sleeve 62 to provide a comfortable gripping location for a user of the striking tool 10.

Figure 5:
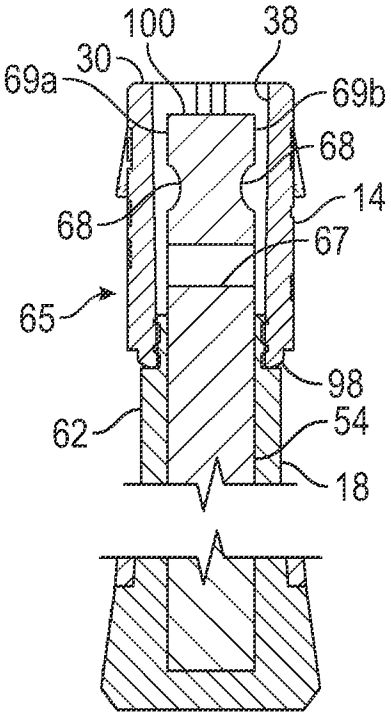
FIG. 5 is a cross-sectional view of the hammer, taken along line 5-5 in FIG. 3.

With reference to FIGS. 2, 4, and 5, the handle 18 includes a mounting portion 65 that includes upper portions 62*a*, 54*a* of the second sleeve 62 and the core 54. The upper portion 54*a* of the core 54 extends outside of the second sleeve 62. A transverse bore 67 extends through the upper portion 54*a*, and a pair of curved recesses 68 are formed in laterally opposite sides 69*a*, 69*b* of the upper portion 54*a* (FIG. 5). The second sleeve 62 includes two fingers 70, 74 extending axially from the upper portion 62*a* and partially surrounding the upper portion 54*a* of the core 54. In some embodiments, the second sleeve 62 may include more than two fingers 70, 74. Each of the fingers 70, 74 includes three, outwardly-extending ribs 78 that are spaced along the fingers 70, 74 in the longitudinal direction. Each of the ribs 78 includes a top surface 82, a bottom surface 86, and a tip 90 defining the outer-most point of the rib 78. In the illustrated embodiment, the top surfaces 82 are angled slightly downward, away from the top side 30 of the head 14.

Best illustrated in FIG. 4, the eye passage 38 is formed with a slight taper from the top side 30 to the bottom side 34, such that an interior wall 94 of the eye passage 38 converges inwardly. The ribs 78 of the first finger 70 are sized to maintain a generally constant clearance distance D between the interior wall 94 and the tips 90 of the respective ribs 78. In the illustrated embodiment, the distance D is about 0.889 millimeters, or between about 0.8 millimeters and about 1 millimeter. Similarly, the ribs 78 of the second finger 74 are sized to maintain a generally constant clearance distance E between the interior wall 94 and the tips 90. In the illustrated embodiment, the distance E is about 1.1427, or between about 1.1 millimeters and about 1.2 millimeters. In other embodiments, the clearance distances D and E may vary.

The mounting portion 65 is inserted into the eye passage 38 of the head 14 until lip 98 located on the sleeve 62 comes into sealing engagement with a periphery of the eye passage 38 on the bottom side 34 of the head 14. A distal end 100 of the handle 18 is recessed beneath the top side 30 of the head 14. In the illustrated embodiment, the distal end 100 is spaced from the top side 30 by a distance F of about 5 millimeters.

Figure 4A:
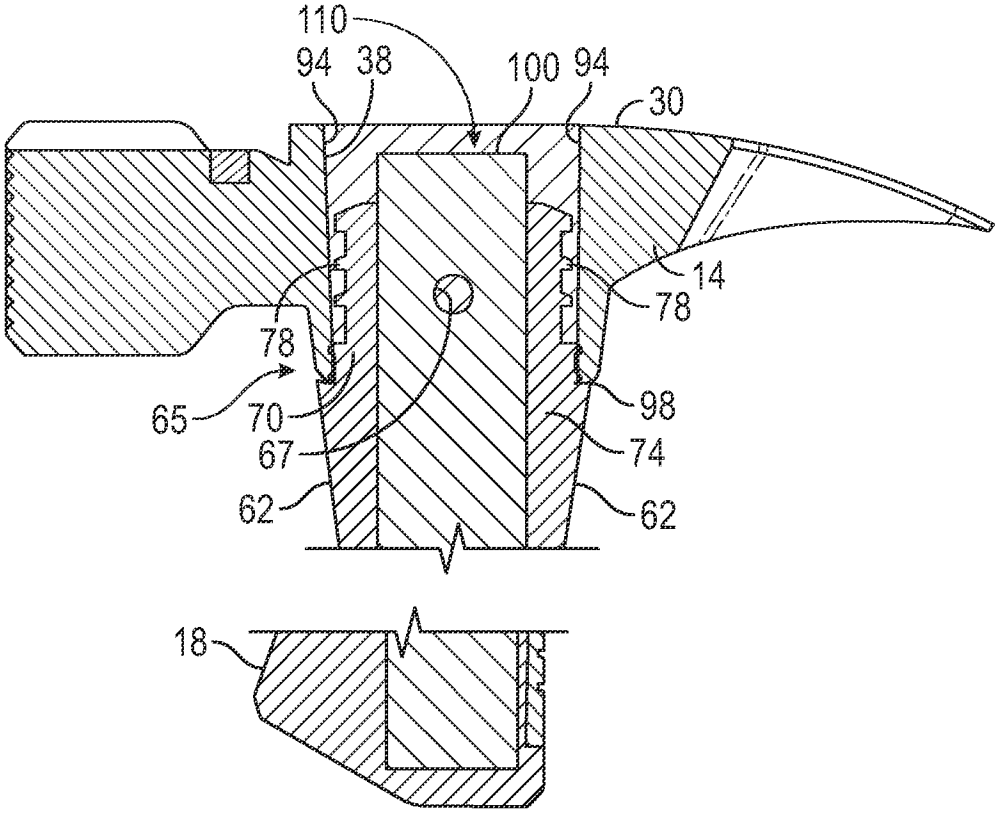
FIG. 4A is a cross-sectional view of the hammer, taken along line 4-4 in FIG. 3 and including a resin surrounding a handle mounting portion of the hammer.

With reference to FIG. 4A, a resin 110, such as a high-strength synthetic epoxy resin, fills in the entire volume between the mounting portion 65 and the eye passage 38, up to the top side 30 of the head 14. Accordingly, the distal end 100 is completely encased in the resin. The resin flows down through the gaps C, D (FIG. 4) between the ribs 78 and the interior wall 94 of the eye passage 38 and into the transverse bore 67 and curved recesses 68 on the upper portion 54*a* of the core 54. The seal created by the lip 98 on the sleeve 62 prevents the resin from leaking out of the eye passage 38 before it has cured. Once cured, the resin forms an adhesive bond between the handle 18 and the head 14. In addition, the resin interlocks with the contours of the ribs 78, fingers 70, 74, bore 67, and recesses 68 to provide a mechanical bond between the handle 18 and the head 14, thereby increasing the strength and durability of the connection.

Various features of the invention are set forth in the following claims.

What is claimed is:

1. A striking tool comprising:

a striking head;

a passage extending through the striking head;

an elongated handle defining a longitudinal axis and having a mounting portion disposed in the passage, the mounting portion including a finger and a plurality of ribs extending outwardly from the finger to define a gap between the ribs and an internal wall of the passage; and a resin filling a volume between the mounting portion and the passage to provide an adhesive bond between the striking head and the handle, wherein the resin interlocks with the ribs to provide a mechanical bond between the striking head and the handle, wherein the striking head includes a top side and a bottom side, and wherein the handle extends into the passage through the bottom side, wherein the passage includes an inner wall that tapers inwardly from the top side to the bottom side, and wherein each of the ribs includes a tip opposite the finger, and wherein each tip is spaced from the inner wall of the passage by a constant distance.

2. The striking tool of claim 1, wherein the finger is one of a plurality of fingers, and a corresponding plurality of ribs extends from each of the fingers.

3. The striking tool of claim 1, further comprising a magnet coupled to the top side of the striking head.

4. The striking tool of claim 1, wherein a distal end of the handle is recessed beneath the top side of the striking head such that the distal end is completely encased by the resin.

5. The striking tool of claim 1, wherein the passage has a teardrop shape.

6. The striking tool of claim 1, wherein the head is made of Grade 5 titanium alloy.

7. The striking tool of claim 1, wherein the handle includes a generally rigid core and a sleeve surrounding the core.

8. The striking tool of claim 7, wherein the core is made of fiberglass and the sleeve is made of polypropylene insert-molded over the core.

9. The striking tool of claim 7, wherein the mounting portion of the handle includes an upper portion of the core and an upper portion of the sleeve.

10. The striking tool of claim 9, further comprising a transverse bore extending through the upper portion of the core, wherein the resin interlocks with the bore to provide an additional mechanical bond between the striking head and the handle.

11. The striking tool of claim 9, wherein the upper portion of the core includes a pair of laterally-opposed, curved recesses, and wherein the resin interlocks with the recesses to provide an additional mechanical bond between the striking head and the handle.

12. The striking tool of claim 9, wherein the finger and the ribs are defined by the upper portion of the sleeve.

13. The striking tool of claim 7, wherein the handle further includes an elastomeric grip portion overmolded on the sleeve.

14. The striking tool of claim 1, wherein the resin is a synthetic epoxy resin.

15. A method of attaching a striking head to a handle of a striking tool, the striking head including a top side and a bottom side, the handle defining a longitudinal axis and including a generally rigid core and a sleeve surrounding the core, the method comprising:

inserting a mounting portion of the handle into a passage extending through the head, the handle extending into the passage through the bottom side, the mounting portion including a finger and a plurality of ribs extending outwardly from the finger to define a gap between the ribs and an internal wall of the passage, wherein the passage includes an inner wall that tapers inwardly from the top side to the bottom side, wherein each of the ribs includes a tip opposite the finger, and wherein each tip is spaced from the inner wall of the passage by a constant distance;

filling a volume between the mounting portion and the passage with a resin;

interlocking the resin with the plurality of ribs extending outwardly from the finger on the sleeve of the handle to provide a mechanical bond between the striking head and the handle.

16. The method of claim 15, further comprising interlocking the resin with a transverse bore extending through the core to provide an additional mechanical bond between the striking head and the handle.

17. The method of claim 15, further comprising interlocking the resin with a pair of laterally-opposed, curved recesses on the core to provide an additional mechanical bond between the striking head and the handle.

* * * * *